US006186874B1

(12) United States Patent
Smith

(10) Patent No.: US 6,186,874 B1
(45) Date of Patent: Feb. 13, 2001

(54) BLADE SHARPENING APPARATUS

(75) Inventor: Richard Smith, Hot Springs, AR (US)

(73) Assignee: Smith Abrasives, Inc., Hot Springs, AR (US)

( * ) Notice: Under 35 U.S.C. 154(b), the term of this patent shall be extended for 0 days.

(21) Appl. No.: 09/273,652

(22) Filed: Mar. 23, 1999

Related U.S. Application Data

(60) Provisional application No. 60/097,057, filed on Mar. 23, 1998.

(51) Int. Cl.[7] ..... B24B 7/00

(52) U.S. Cl. ..... 451/164; 451/170

(58) Field of Search ..... 451/45, 162, 163, 451/164, 170, 241, 270, 293, 356, 392, 393, 552, 555, 556, 558, 234

(56) References Cited

U.S. PATENT DOCUMENTS 3,956,856 * 5/1976 Yonkers ..... 51/59 R
4,231,194 * 11/1980 Glesser ..... 51/211 R
4,468,894 * 9/1984 Hong ..... 51/109 BS
4,850,149 * 7/1989 Phillips ..... 51/102
5,005,319 * 4/1991 Friel ..... 51/58
5,245,791 * 9/1993 Bigliano et al. ..... 51/128
5,620,359 * 4/1997 Harrison et al. ..... 451/45
5,759,093 * 6/1998 Rodriguez ..... 451/356

* cited by examiner

*Primary Examiner*—Timothy V. Eley
*Assistant Examiner*—Dung Van Nguyen
(74) *Attorney, Agent, or Firm*—Edward D. Gilhooly

(57) ABSTRACT

A blade sharpening apparatus having a hollow housing with an internal drive motor for inducing back and forth movement on a pair of aligned elongated abrasive stones. The abrasive stones are retained by a stone holder and possess a cross section in the form of a equilateral triangle. A slidable guide is slidably mounted on the housing above the pair of abrasive stones. The abrasive stones have a portion of two faces extend through the slidable guide. The slidable guide includes a pair of flat guide surfaces for supporting a blade to be sharpened.

19 Claims, 6 Drawing Sheets

FIG. 7
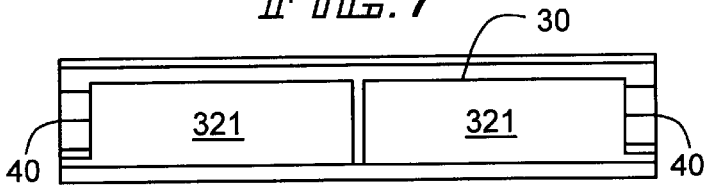
FIG. 8
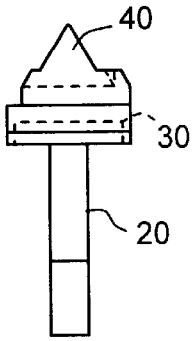
FIG. 9
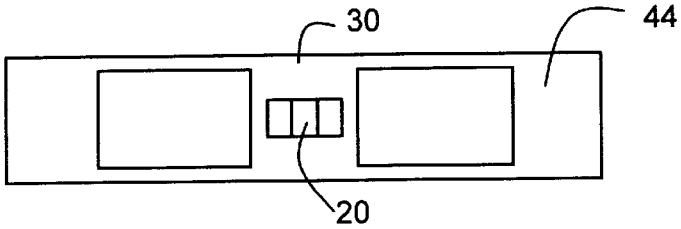
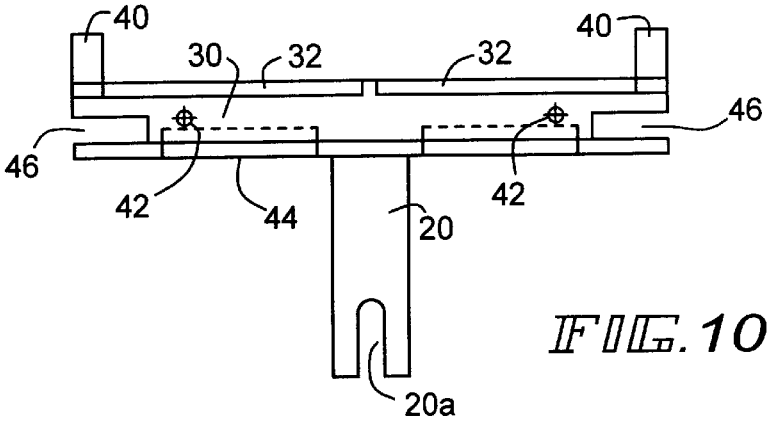
FIG. 10
FIG. 11
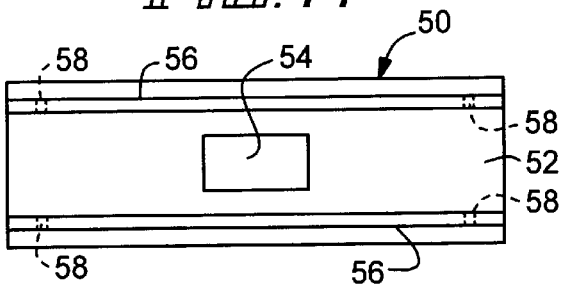
FIG 13
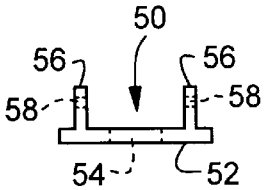
FIG. 12
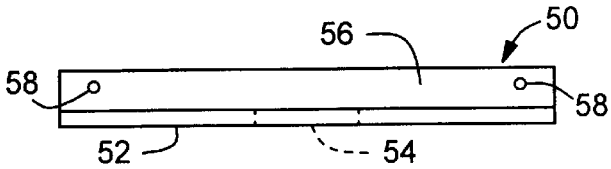

BLADE SHARPENING APPARATUS

This application claims benefit of provisional application 60,097,057 filed Mar. 23, 1998.

BACKGROUND OF THE INVENTION

1. Field of the Invention

This invention relates in general to knife sharpeners and more specifically, to a blade sharpening apparatus capable of sharpening knives having serrations or having flat edges.

2. Description of the Prior Art

Typically, knives for many uses are constructed with a blade having either a serrated cutting edge or a flat edge. A serrated edge is particularly difficult to sharpen. Because of the nature of a serrated edge of a blade and its possible range of dimensions, known sharpener devices have not been able to satisfactorily sharpen both a serrated edge of a wide range of sizes and a straight edge in an effective manner. Prior sharpener designs have required that the sharpening stone be replaced by other stones in order to sharpen either a serrated edge, accommodate all sizes of serrations, and also sharpen flat edges. Known sharpeners also have a tendency to operate at high speeds that can cause heat build up and remove the temper of the knife blade. Past known devices are further deficient in providing a guide that permits sharpening to occur at optimum angles. Accordingly, there is a need in the prior art to provide an improved knife sharpener capable of sharpening knives having serrated edges of all sizes and flat edges as well in an efficient and effective manner.

SUMMARY OF THE INVENTION

It is, therefore, an objective of this invention to provide an improved blade sharpening apparatus capable of sharpening knives and the like having serrated edges of all sizes and flat blades. The invention of the application includes sharpening stones having an unique triangular configuration of equal sized faces that allow for superior sharpening of serrations and that allow the stones to be rotated to extend wear. The stones are moved in a back and forth stroke by an improved drive mechanism to assure superior sharpening. A slidable blade guide allows the user to select a coarse stone for initial edge sharpening or to repair damaged edges or alternatively, a fine stone to grind a final finished edge on the knife or to sharpen already sharp knives. The slidable guide also acts to provide a guide surface to sharpen a blade at an optimum angle. The knife sharpener of the invention is portable in nature and can be powered by batteries or other sources of electrical potential.

BRIEF DESCRIPTION OF DRAWINGS

FIG. 7 is a top plan view of the stone holder of the blade sharpener apparatus of FIG. 1;

FIG. 8 is an end elevational view of the stone holder of FIG. 7;

FIG. 9 is a bottom plan view of the stone holder of FIG. 7;

FIG. 10 is a front elevational view of the stone holder of FIG. 7;

FIG. 11 is a top plan view of the stone holder rack of FIG. 11;

FIG. 12 is a front elevational view of the stone holder rack of FIG. 11;

FIG. 13 is an end elevational view of the stone holder rack of FIG. 11;

DESCRIPTION OF THE PREFERRED EMBODIMENT

Figure 1:
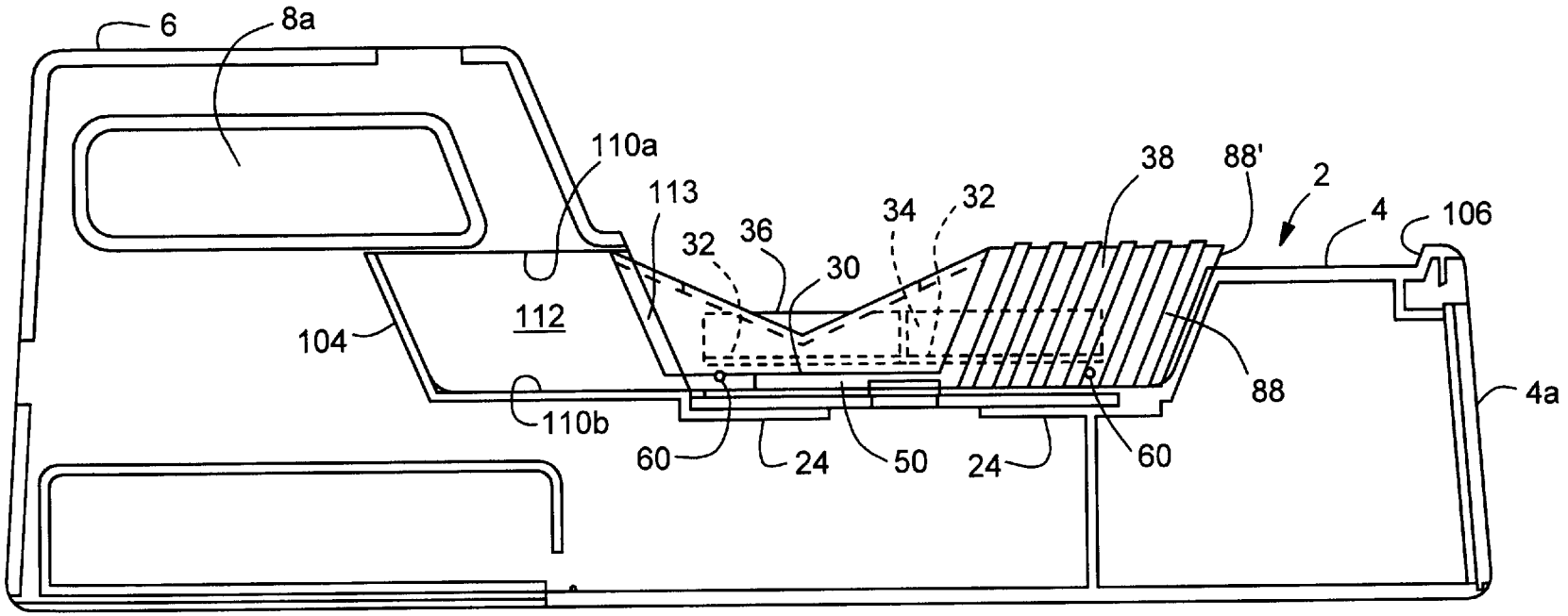
FIG. 1 is a partial side elevational view of the blade sharpener apparatus of the invention and showing one-half of the interior of the housing.
Figure 1A:
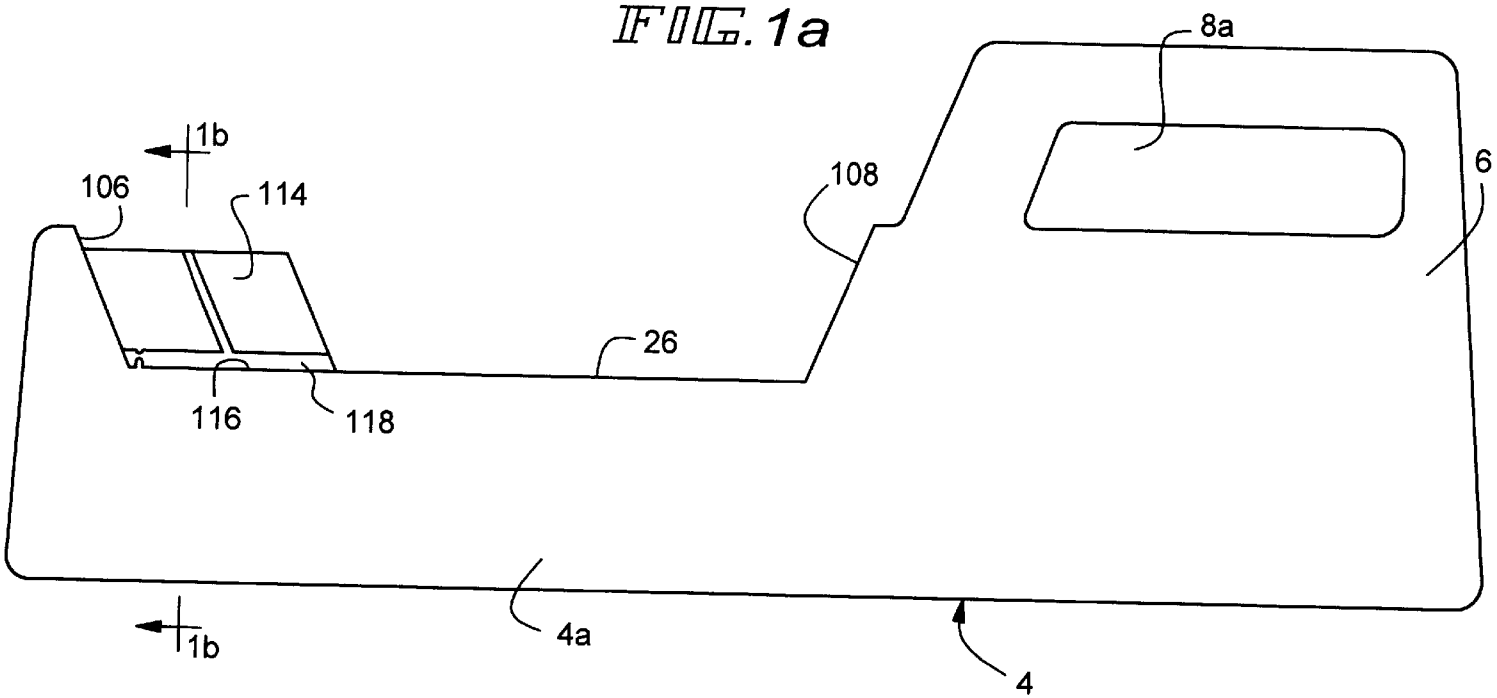
FIG. 1*a* is a side elevational view, with parts removed, of the exterior of the housing of FIG. 1.
Figure 1B:
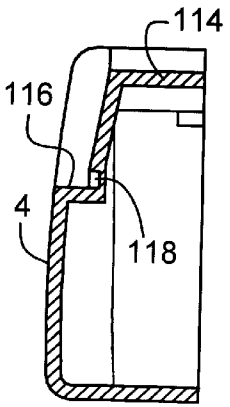
FIG. 1*b* is an end elevational view,,with parts in section, taken along lines 1*b*—1*b* of FIG. 1*a*.
Figure 2:
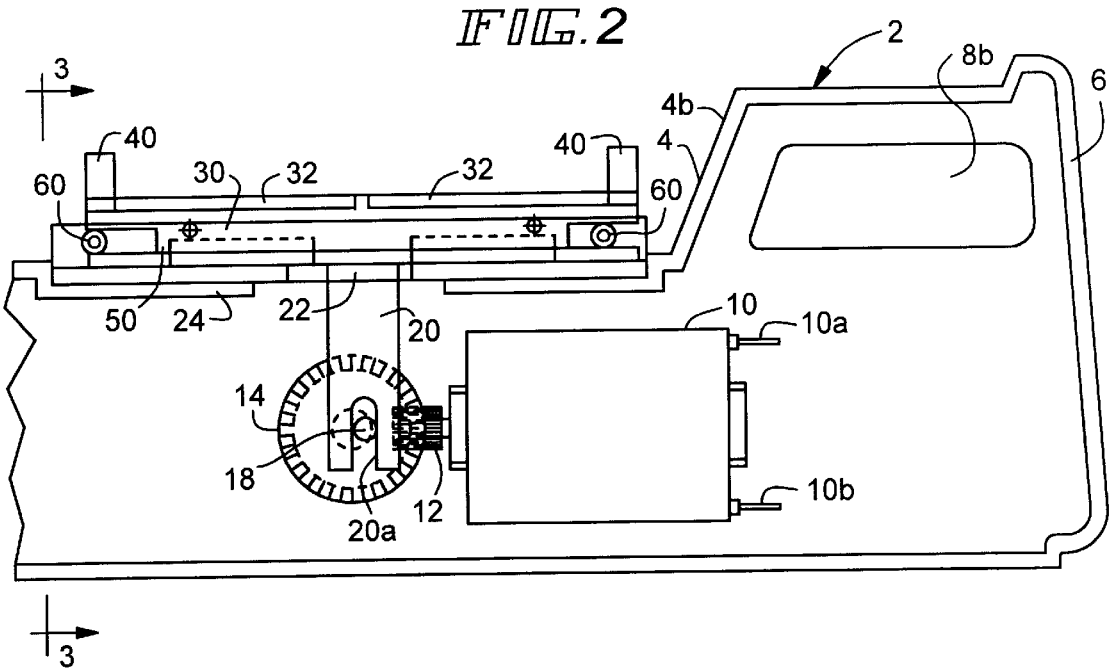
FIG. 2 is a partial side elevational view, with parts removed, of the other half of the blade sharpener apparatus of the invention, showing the drive mechanism and other half of the housing.

Referring now to FIGS. 1, 1*a*, 1*b*, 2 and 3, there is illustrated the improved blade sharpening apparatus of the invention, generally designated by reference numeral 2. In FIG. 1, a first half portion 4*a* of housing 4 of the blade sharpening apparatus 2 is shown. The half portion 4*a* substantially conforms to the configuration of the other half portion 4*b* of the housing 4 which is illustrated in FIG. 2. The two housing portions 4*a*, 4*b* to form housing 4 are retained together by suitable mechanical fasteners and retention elements (not shown). Referring to FIGS. 1, 1*a* and 2, the two portions 4*a* and 4*b* of the housing 4 include handle openings 8*a* and 8*b* formed on an enlarged end 6 of housing by which the blade sharpening apparatus 2 can be manipulated by a user. Housing 4 including portions 4*a* and 4*b* may be formed from a suitably durable plastic material.

Figure 3:
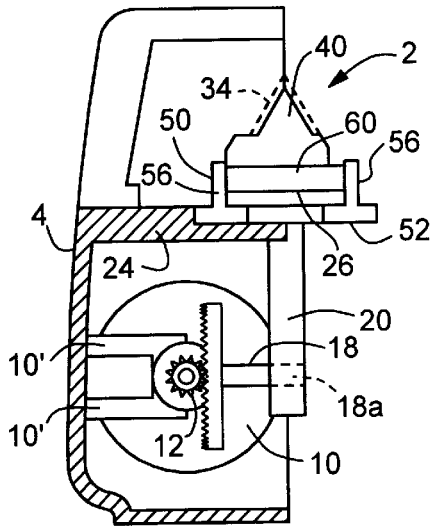
FIG. 3 is a partial end elevational view, with parts in sections, taken along lines 3—3 of FIG. 2.
Figure 4:
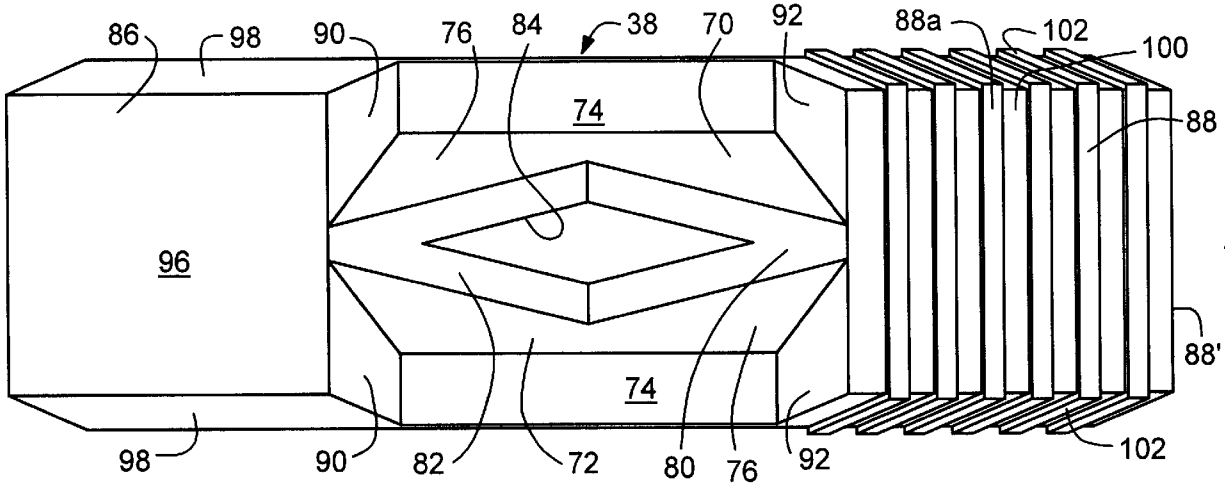
FIG. 4 is a top plan view of the blade angle guide of the blade sharpening apparatus of FIG. 1.

The blade sharpening apparatus 2 is powered by a conventional electric motor 10 capable of rotating a pinion gear 12 rotatably attached to the output shaft of the motor 10. The motor 10 can be any type of electric motor that can be powered by electrical batteries (not shown) or an external electrical power source. The electrical batteries are arranged to be mounted in a suitable manner (not shown) within housing 4. In one form of the invention, the motor is driven by four "C" cell batteries, but other batteries may be used dependent on motor requirements. The batteries are electrically connected to leads 10*a* and 10*b* by a conventional electrical circuit by which an external on/off switch (not shown) is used to actuate the electric motor 10 as needed. As seen in FIG. 3, the motor is mounted on two pairs of rigid rods 10' (two of which are shown in FIG. 3) at both ends of motor 10 in a manner to secure the motor in position as shown within housing 4. A pinion gear 12 engages a crown gear 14 that is secured to a shaft 18 and extends transverse to the axis of rotation of the pinion gear 12. The end 18*a* of shaft 18 engages the U-shaped slot 20*a* of the actuator lever 20 as seen in FIG. 3 and FIG. 10. The shaft 18 is mounted on off-center axis with respect to the center of the crown gear 14 to drive the actuator lever 20 and produce a back and forth motion on the actuator lever 20. As seen in FIG. 3, the actuator lever 20 extends up through a opening 22 provided in an intermediate upper wall 24 of housing 4.

The top end of actuator lever 20 is secured to a grinding stone holder 30 as seen in FIGS. 2, 3 and 10. The stone holder 30 includes a pair of pockets 32 for respectively receiving a pair of grinding stones 34 and 36 as shown in FIG. 1. The stones 34 and 36 respectively comprise a fine stone and a coarse stone for various sharpening operations. For example, the coarse stone 36 may be used to sharpen the serrated edge or flat edge of a damaged blade or can be used in an initial sharpening operation. The fine stone 34 can be used to finish a sharpening operation or to sharpen up relatively sharp edges. As will be discussed later, the stones 34 and 36 can be alternately exposed for sharpening by sliding the angle guide 38 that is disposed above the stones. The angle guide 38 is slidable in either direction to expose one of the stones 34, 36 and cover the other stone as will be described later. As seen in FIGS. 1 and 2, the stones 34 and 36 are mounted above housing top 24 in a depressed area which is disposed intermediate of the length of the housing 4. The actuator lever 20 moves the stone holder 30 and the stones 34, 36 in a limited back and forth stroke along the longitudinal axis of the housing 4 for an extent, for example, of 1/16" or other suitable distance.

In FIGS. 7, 8 and 9, it is shown that the two pockets 32 of stone holder 30 are closed at one end by triangular shaped projections 40. The stones 34 and 36 each have a triangular cross section of a configuration having equal sides by which a lower flat side rests respectively in pockets 32 of the stone holder 30. The stone holder 30 includes a pair of holes 42 by which a screw or other threaded member may engage the stones 34 and 36 to retain them in position on stone holder 30 and allow that the stones to be removed. Because of the triangular shape of the stones 34 and 36, they are capable of being rotated to extend the useful lifetime service of sharpening. The unique shape of the triangular stones further effectively sharpens serrated blade edges of any size and can also be used to sharpen flat blades with effectiveness without changing the stone. The lower body 44 of the stone holder 30 is mounted on a stone holder rack 50 as best seen in FIGS. 11, 12 and 13. The area of the cross-section of stones 34 and 36 is larger than the area of triangular shaped projections 40, such that the upper surfaces 34*a*, 36*a* extend beyond projections 40 as shown in phantom in FIG. 3. The stone holder 30 is further provided with a pair of open ended slots 46 at each end. Both the stone holder 30 and the stone holder rack 50 may be fabricated from a plastic or other durable material.

Referring now to FIGS. 1, 2, 3 and 11 to 13, there is illustrated the stone holder rack 50 upon which is the stone holder 30 is mounted. The stone holder rack 50 is suitably retained on housing 4 and permits the back and forth motion of the stone holder rack 50. The stone holder rack 50 includes a flat bottom member 52 having an opening 54 through which actuator lever 20 extends. A pair of the flat projections 56 project upward at a position inward from the opposite edges of flat bottom member 52. Two pairs of aligned holes 58 are provided in upward projections 56. The holes 58 receive pins 60 as best seen in FIG. 1 with said pins 60 being positioned in end slots 46 of stone holder 30. The pins 60 retain the stone holder 30 and stones 34, 36 from raising up when pressure is being applied by a blade to a stone during sharpening.

Referring to FIGS. 1, 4, 5, 6, 14 and 15 details of the blade angle guide 38 are shown. Although not so limited, the blade angle guide 38 can be fabricated from a suitable metal and the like. The blade angle guide 38 is formed as a one-piece body 70 having an intermediate upper blade sharpening section 72. The sharpening section 72 includes a pair of lower ledges 74 intersecting a pair of sloped side surfaces 76. The side surfaces 76 terminate with a pair of flat blade angle surfaces 80 and 82 which angle downward toward the center of blade sharpening section 72. The angles of incline of surfaces 80, 82 are selected to act as a base surface and guide for a blade (not shown) being sharpening for engaging a selected stone 34 and 36 at an optimum angle. An opening 84 is provided in surfaces 80 and 82 to allow the upper edge portion (FIG. 1) of either triangular stone 34 or 36 to project upward through opening 84 for sharpening. The sharpening section 72 is integral with two end portions 86 and 88 by two pairs of transverse sections 90, 92 disposed above ledges 74 and adjacent sloped surface 76. The end portion 86 is formed by an upper surface 96 and a pair of side sections 98 forming an open bottom in a modified inverted U-shape. The end portion 88 similarly includes an upper surface 100 and a pair of side sections 102 also having a modified inverted U-shape. The outer surface of at least end portion 88 has a gripping surface, such as ribs 88*a* as shown in FIG. 4, 5, 6, 14 and 15.

As seen in FIGS. 1, 1*a* and 1*b* the blade guide is moveable between a wall 104 correspondingly formed on housing portions 4*a*, 4*b* to stop surface 106 adjacent one end of housing 4. The housing 4 forms an open blade guide compartment 108 for the receiving end portion 86 of blade guide 38 in the position shown in FIG. 1. As seen in FIG. 1, the compartment 108 is formed by back wall 104, upper and lower walls 110*a*, 110*b* and side wall 112 (one of which is shown) which have a configuration to receive end section 86 through opening 113 with end 86*a* of end portion 86 is in contact or near contact with a back wall 104. In the position of blade angle guide 38 shown in FIG. 1, stone 36 is exposed for sharpening, while stone 34 is covered.

Figure 6:
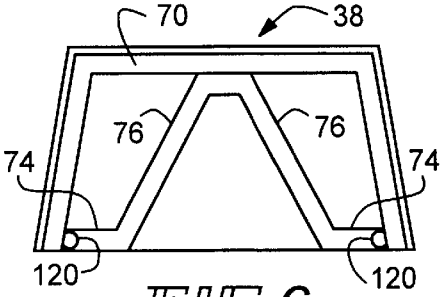
FIG. 6 is an end elevational view of the angle guide of FIG. 4.
Figure 5:
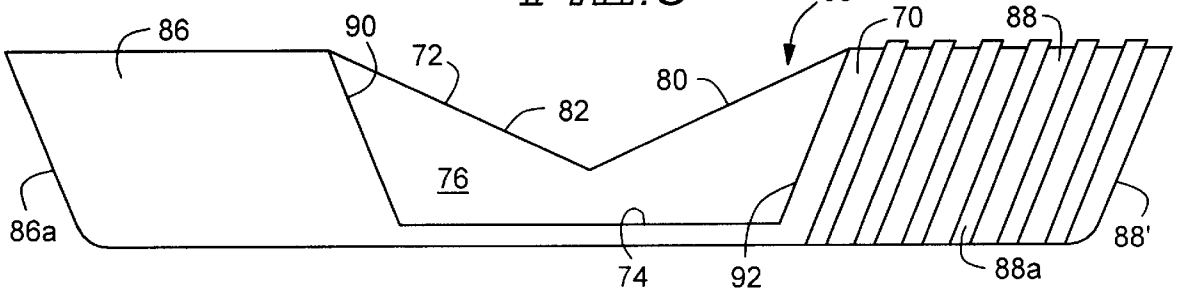
FIG. 5 is a side elevational view of the blade angle guide of FIG. 4.
Figure 14:
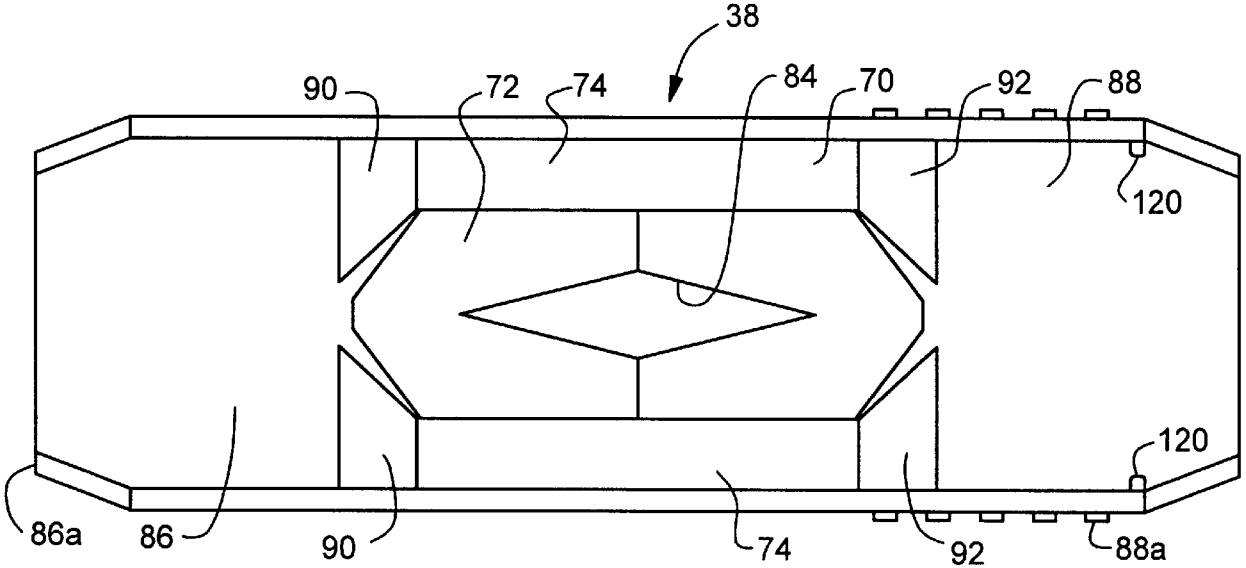
FIG. 14 is a bottom plan view of the blade angle guide of FIG. 4.
Figure 15:
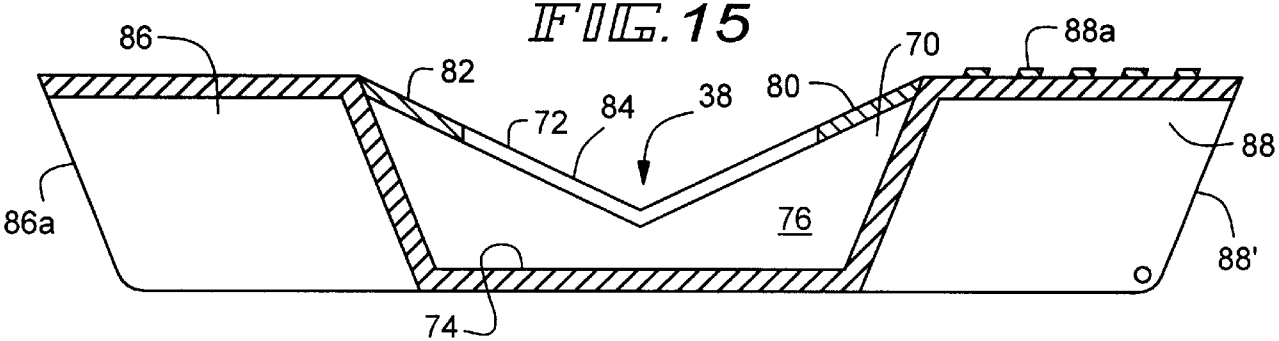
FIG. 15 is a side elevational view taken along lines 15—15 of FIG. 14.

The blade guide 38 is further moveable to a second position exposing stone 34 and covering stone 36 by which the end 88' of portion 88 contacts or is in near contact with stop 106. The end portion 88 moves into surrounding exterior relation to upper reduced section 114 of the housing 4 having a correspondingly similar but smaller configuration than the cross sectional shape of end portion 88 as seen in FIGS. 1*a* and 1*b*. The blade guide 38 moves on its lower edge along the housing 4 on lower wall l110*b*, wall 24 and a ledge 116. The ledge 116 is outwardly disposed below upper reduced section 114 under which a slot 118 is formed. As seen in FIGS. 6 and 14, a pin 120 is attached to the lower edges of end portion 88 of blade guide 38 to engage the slot 118 for movement and securement. A portion of the end portion 86 of blade guide 38 is captured in compartment 108 when end 88' contacts stop 106 to aid in securement.

What is claimed is:

1. A blade sharpening apparatus comprising housing, a pair of abrasive stones mounted on said housing for sharpening a blade, slideable guide means mounted on said housing adjacent to said pair of abrasive stones, said guide means having a guide surface to angularly orient the blade relative to said guide surface, said slideable guide means being moveable relative to said housing to expose alternately one of said pair of abrasive stones and generally cover the other of said pair of abrasive stones, and vibratory means operatively coupled to pair of abrasive stones for moving said pair of abrasive stones relative to said guide surface.

2. The blade sharpening apparatus according to claim 1 wherein said pair of abrasive stones include a pair of intersecting flat faces for contacting the blade.

3. The blade sharpening apparatus according to claim 3 wherein said pair of abrasive stones have triangularly shaped cross sectional configurations.

4. The blade sharpening apparatus according to claim 2 wherein said pair of abrasive stones have a different grinding coarseness.

5. The blade sharpening apparatus according to claim 4 wherein said pair of stones are mounted end to end relative to each other on said housing.

6. The blade sharpening apparatus according to claim 5 wherein said vibratory means moves said pair of stones along an axis perpendicular to said triangular cross-section.

7. The blade sharpening apparatus according to claim 1 wherein said one of said pair of abrasive stones extends upward through said slideable guide means to expose one of the abrasive stones for sharpening, said guide surface being positioned adjacent said one of said abrasive stones.

8. The blade sharpening apparatus according to claim 7 wherein said slideable guide means includes a pair of flat intersecting surfaces positioned adjacent said exposed one of said abrasive stones.

9. The blade sharpening apparatus according to claim 8 wherein said slidable guide means includes a pair of inverted U-shaped sections disposed on opposite side of said pair of flat intersecting surfaces.

10. The blade sharpening apparatus according to claim 9 wherein said pair of abrasive stones have a cross-sectional shape in the form of a equilateral triangle.

11. The blade sharpening apparatus according to claim 10 wherein said pair of abrasive stones are removable for remounting on said housing means to expose a third side of said stone through said slidable guide means.

12. The blade sharpening apparatus according to claim 10 wherein said pair of abrasive stones have different abrasive characteristics.

13. A blade sharpening apparatus comprising housing means, abrasive means mounted on said housing means for sharpening a blade, slideable guide means mounted on said housing means adjacent to said abrasive means, said guide means having a guide surface to angularly orient the blade relative to said abrasive means, vibratory means operatively coupled to said abrasive means for moving said abrasive means relative to said guide surface, and said housing means includes track means for slidably mounting said slideable guide means.

14. A blade sharpening apparatus comprising housing means, abrasive means mounted on said housing means for sharpening a blade, slideable guide means mounted on said housing means adjacent to said abrasive means, said guide means having a guide surface to angularly orient the blade relative to said abrasive means, vibratory means operatively coupled to said abrasive means for moving said abrasive means relative to said guide surface, said abrasive means extends upward through said slideable guide means to expose a portion of the abrasive means, said guide surface being positioned adjacent said portion of said abrasive means, said slideable guide means includes a pair of flat intersecting surfaces positioned adjacent said exposed portion, said slideable guide means includes a pair of inverted U-shaped sections disposed on opposite side of said pair of flat intersecting surfaces, said abrasive means includes a pair of elongated abrasive stones having a pair of flat upper surfaces, said pair of flat upper surfaces forming said portion of the abrasive means, said pair of abrasive stones have a cross-sectional shape in the form of a equilateral triangle, and a stone holder mounted on said housing means for orienting said pair of abrasive stones in alignment along an axis in end to end relationship.

15. The blade sharpening apparatus according to claim 14 wherein said pair of abrasive stones are moved by said vibrating means along said axis.

16. The blade sharpening apparatus according to claim 15 wherein said slideable guide means is selectively moveable along said axis to expose a portion of one of said abrasive stones.

17. A blade sharpening apparatus comprising a housing, at least one abrasive element mounted on said housing for sharpening a blade, a guide member mounted on said housing adjacent to said at least one abrasive element, said guide means having a guide surface to angularly orient the blade relative to said at least one abrasive element, vibratory means operatively coupled to said at least one abrasive stone for moving said abrasive element relative to said guide surface, said least one said abrasive element including a cross sectional configuration having a triangular cross sectional configuration forming three generally flat abrasive surfaces extending parallel along an axis, and means for adjustably mounting said at least one abrasive element relative to said guide surface for selectively permitting at least one of said three abrasive surfaces to be disposed adjacent the guide surface.

18. The blade sharpening apparatus according to claim 10 wherein said pair of abrasive stones respectively have different grinding coarsenesses.

19. A blade sharpening apparatus comprising a housing, at least one abrasive element on said housing for sharpening a blade, a guide member mounted on said housing adjacent to said at least one abrasive element, said guide member having a guide surface to angularly orient the blade relative to said at least one abrasive element, vibratory means operatively coupled to said at least one abrasive element for moving said abrasive element relative to said guide surface, said least one said abrasive element including a cross sectional configuration having a triangular cross sectional configuration forming three generally flat abrasive surfaces extending parallel along an axis, and means for adjustably mounting said at least one abrasive element relative to said guide surface for selectively permitting at least one of said three abrasive surfaces to be disposed adjacent the guide surface.

* * * * *